United States Patent [19]

Galis et al.

[11] 4,426,970

[45] Jan. 24, 1984

[54] RESILIENT DRIVE FOR FUEL INJECTION PUMP GOVERNORS

[75] Inventors: Leon A. Galis, Ludlow; Richard J. Czarnik, Easthampton, both of Mass.

[73] Assignee: Ambac Industries, Inc., Springfield, Mass.

[21] Appl. No.: 224,001

[22] Filed: Jan. 12, 1981

[51] Int. Cl.[3] ..... F02D 31/00

[52] U.S. Cl. ..... 123/364; 464/3; 73/526; 123/365; 123/372

[58] Field of Search ..... 123/363, 364, 370, 373, 123/371, 372, 365; 73/526, 536; 464/3, 180

[56] References Cited

U.S. PATENT DOCUMENTS

| | | | |
|---|---|---|---|
| 2,622,215 | 12/1952 | Piikarski | 464/3 |
| 3,269,193 | 8/1966 | Kleeberger | 73/526 |
| 3,699,816 | 10/1972 | Peltret | 73/526 |
| 3,922,884 | 12/1975 | Chapman | 464/3 |
| 4,263,881 | 4/1981 | Isobe | 123/364 |

FOREIGN PATENT DOCUMENTS

| | | | |
|---|---|---|---|
| 2113571 | 9/1972 | Fed. Rep. of Germany . | |
| 701190 | 12/1953 | United Kingdom . | |
| 810612 | 3/1959 | United Kingdom . | |
| 761733 | 9/1980 | U.S.S.R. | 123/363 |

*Primary Examiner*—Charles J. Myhre
*Assistant Examiner*—Carl Stuart Miller
*Attorney, Agent, or Firm*—Richard D. Weber

[57] ABSTRACT

A resilient drive for a fuel injection pump governor comprising a resilient coupling connecting the governor speed sensing mechanism to the governor shaft. In a preferred embodiment, the governor flyweight assembly is rotatably mounted with respect to the governor shaft and is connected thereto by a resilient coupling which permits the limited momentary rotation of the flyweight assembly with respect to the shaft to dampen torsional vibrations.

1 Claim, 9 Drawing Figures

RESILIENT DRIVE FOR FUEL INJECTION PUMP GOVERNORS

BACKGROUND OF THE INVENTION

The present invention relates generally to speed regulating devices for internal combustion engines and relates more particularly to a resilient drive for diesel engine fuel injection pump governors.

Fuel injection pump governors, although of various types, all include essentially a mechanism for sensing the speed of the engine, and means for adjusting the engine fuel control in response to speed changes. In a common form of governor for which the present invention has been developed, the engine speed is sensed mechanically, for example by a flyweight assembly, which assembly is mounted on a governor shaft which is rotated at a speed corresponding to engine speed. In a conventional installation, the governor shaft is gear driven from the fuel injection pump, the camshaft of which is coupled directly to the engine for rotation, typically at one half engine speed.

When the engine is running at a constant speed, the governor flyweights should also sense a constant speed and be extended in a stable attitude, operating against a spring force to provide a positioning of the governor linkage in a stable position commensurate with the engine speed. However, inherent in the injection pump drive train, due in large measure to the intermittent torsional forces required to actuate the fuel pumping mechanism, are instantaneous acceleration and deceleration effects which pass into the governor shaft and are sensed by the flyweight assembly. These torsional vibrations, known as "torsionals", interfere with the stability of the flyweights and governor linkage, in some cases causing a surging tendency of the governor. Torsionals also have a deleterious effect on the governor pivot points which tend to wear due to the constant chattering induced by the torsionals at these points.

SUMMARY OF THE INVENTION

In the present invention, a resilient coupling is provided between the governor drive shaft and the flyweight carrier for the purpose of filtering or dampening out the torsionals. In a preferred form of the embodiment, the governor flyweights are carried on a spider disposed on the governor shaft but rotatable with respect thereto. A spider adaptor and spider retainer secured to the governor shaft are coupled to the spider by means of a resilient coupling which insures the rotation of the spider with the governor shaft but which permits a resilient limited relative rotation of the spider with respect to the shaft.

In a preferred form, the resilient coupling comprises a pair of compression springs disposed transversely with respect to the governor shaft and spaced on opposite sides thereof. The compression springs are each supported at one end by the spider and at the other end by the spider adaptor and spider retainer and thus serve to hold the spider in a normal operating position with respect to the governor shaft. The springs allow, however, an angular displacement of the spider with respect to the governor shaft in either direction from the normal operating position in response to instantaneous acceleration or deceleration forces. The resilient coupling, by permitting the momentary relative movement of the spider and flyweights with respect to the shaft, effectively dampens out the acceleration or deceleration forces and thereby minimizes or eliminates any reaction of the flyweights to such forces.

It is accordingly a primary object of the present invention to provide a resilient coupling for a fuel injection pump governor speed sensing device which will effectively filter or dampen out torsional vibrations transmitted thereto by the drive train.

It is a further object of the invention to provide a resilient drive means as described of a relatively simple, compact design which can readily be adapted to existing forms of fuel injection pump governors.

Additional objects and advantages of the invention will be more readily apparent from the following detailed description of an embodiment thereof and the accompanying drawings.

DESCRIPTION OF THE PREFERRED EMBODIMENT

Figure 1:
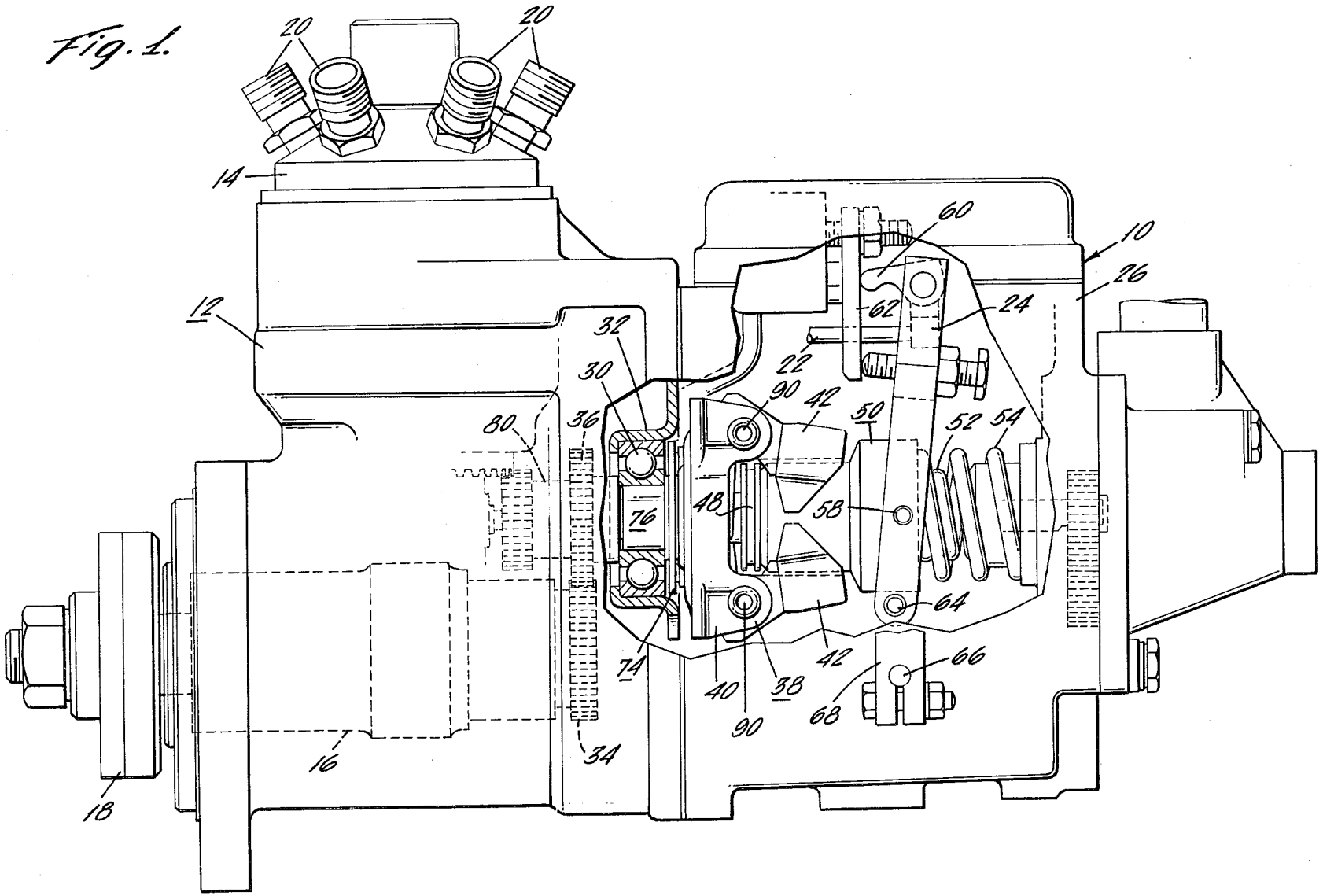
FIG. 1 is a side elevational view of a fuel injection pump and governor partly broken away and in section, the governor being provided with a resilient drive in accordance with the present invention and being shown in a non-rotating condition.

Referring to the drawings and particularly FIG. 1 thereof, a governor 10 having a resilient drive in accordance with the present invention is shown mounted on a fuel injection pump 12 of a conventional construction. The pump includes a hydraulic head 14 within which a pumping and distributing plunger (not shown) is driven in rotation and reciprocation by the pump camshaft 16 which is connected by coupling 18 to the engine for rotation at a speed corresponding to engine speed. In a typical pump of this type, the pump drive speed is one half engine speed. Fuel pumped by the plunger is delivered through the outlet conduits 20 in timed sequence, the conduits 20 being connected directly to the injection nozzles of the engine.

The fuel quantity delivered by the pumping plunger is determined by the position of a fuel control sleeve (not shown) which is in turn controlled by movement of a fuel control rod 22 (only partially shown) connected to the upper end of the governor fulcrum lever 24. As viewed in FIG. 1, the movement of the control rod 22 to the left would increase the fuel delivery, while movement to the right would decrease fuel delivery.

The governor 10 includes a housing 26 within which a governor shaft 28 is horizontally disposed for rotation at a speed proportional to engine speed. The governor shaft 28 is supported adjacent one end by a bearing assembly 30 on bearing support plate 32 secured to the housing and at its opposite end by a similar bearing assembly (not shown). A drive gear 34 on the camshaft engages a gear 36 on the governor shaft to drive the governor shaft at the same speed as the pump camshaft.

Figure 3:
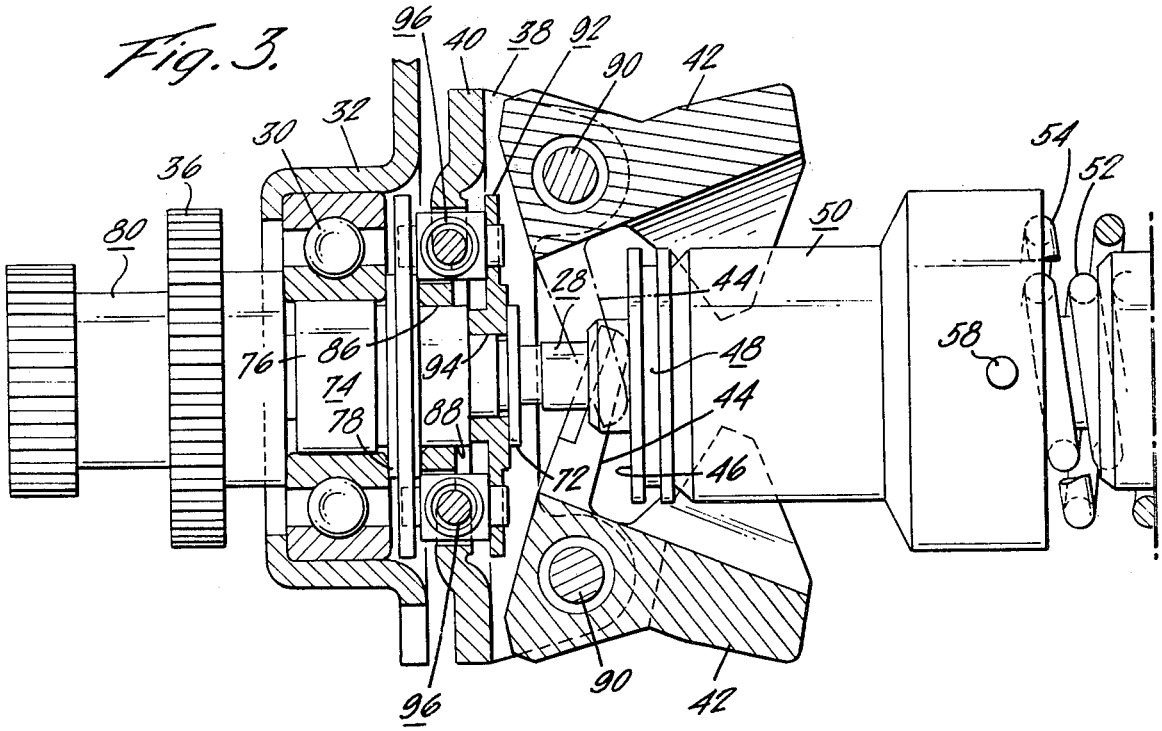
FIG. 3 is a view similar to FIG. 2 showing the positions of the flyweights and governor elements during engine operation.
Figure 4:
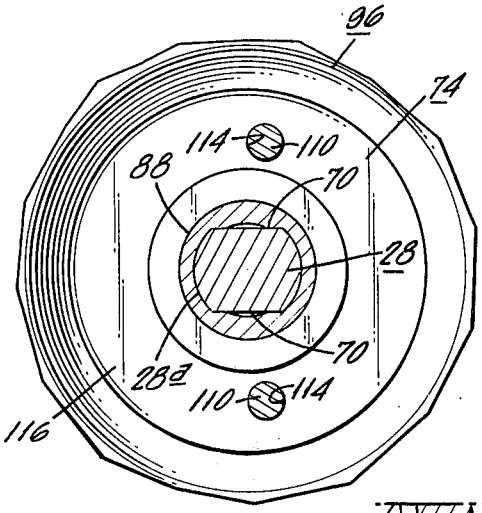
FIG. 4 is a sectional view taken along line 4—4 of FIG. 2.

A flyweight assembly 38 is carried on and rotates with the governor shaft 28 and comprises a spider 40 on which a pair of flyweights 42 are pivotally mounted. As shown more clearly in FIG. 3, the flyweights include fingers 44 which engage a radial face 46 of a thrust bearing assembly 48 on the governor sleeve 50. Centrifugal force acting on the flyweights 42 during rotation of the governor shaft extends the flyweights as shown in FIG. 3 and urges the fingers 44 thereof against the thrust bearing 48 to move the sleeve 50 to the right on the governor shaft. The sleeve movement is opposed by a spring assembly comprising an inner spring 52 and an outer idling spring 54, said springs seating on a spring seat member 56 secured to the housing 26.

When the engine is rotating at idling speeds, the inner spring 52 is fully extended and exerts no force on the governor sleeve 50. The idling spring 54, which has a much lower spring weight than the inner spring, exerts its relatively light axial force urging the sleeve toward the flyweight assembly. As the engine speed increases above the idling speed, the inner spring 52 in addition to the idling spring 54 act in opposition to the flyweights and together determine a single position of the governor sleeve 50 for any given speed of the engine.

The fulcrum lever 24 includes a yoke-like lower portion which passes around the governor sleeve and which is pivotally connected therewith at 58. The upper end of the fulcrum lever carries a full load cam 60 which cooperates with a full load stop plate 62 under certain engine operating conditions. The lower end of the fulcrum lever 24 is pivotally connected at 64 to a trunion lever (not shown) which is mounted on a shaft 66 carrying the operating lever 68 (partially shown). The operating lever 68 is connected to the engine throttle.

The governor as described above is essentially of a conventional type and is interposed between the throttle and the fuel control rod to control the fuel delivery under certain engine speed conditions. For example, governors function in a well known manner to maintain a minimum fuel delivery to prevent stalling at idle as well as to limit the maximum fuel delivery to prevent overspeeding of the engine. Such governors can further control engine torque as a function of speed throughout the speed range of the engine.

The present invention is not directly concerned with the details of the governor fuel control linkage and the governor illustrated is only an example of the type of governor for which the invention could be suitably used. The invention is directed to a resilient drive for the governor speed sensing means and specifically in the present embodiment to the manner of connecting the spider 40 and flyweights 42 to the governor shaft 28 so as to dampen the momentary acceleration and deceleration forces delivered thereto through the fuel pump drive train.

Conventionally, the governor flyweight spider 40 is driven in rotation by the governor shaft by means of a friction clutch arrangement, which may either be directly connected with the spider or may, in another type of governor, be associated with the pump drive gear. Although the purpose of such clutch drives was to dampen the torsional vibrations which tend to interfere with smooth governor operation, the friction clutches necessarily permit some slippage of the members so that the spider may not be accurately reflecting the engine speed, at least momentarily. Furthermore, the opportunity for wear exists with friction type clutches, and the accuracy of the speed sensing mechanism of the governor may be further impaired.

With the present invention, the governor flyweights and spider always rotate in phase with the governor shaft although they may be angularly displaced with respect thereto briefly to absorb the momentary acceleration and deceleration effects characteristic of the injection pump drive.

Figure 2:
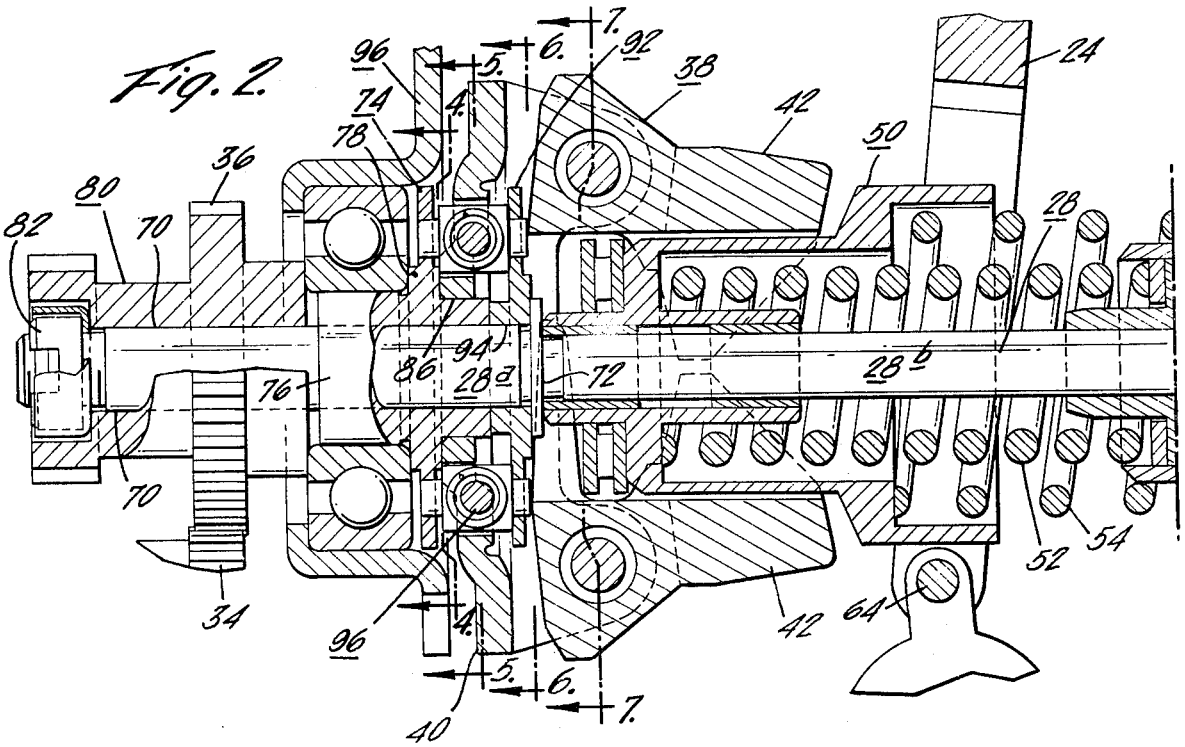
FIG. 2 is an enlarged sectional view of the governor shaft and associated elements of the governor shown in FIG. 1.

Referring to FIG. 2, the governor shaft 28 comprises a larger diameter portion **28*a* having flats 70 on opposite sides thereof throughout its length, and a smaller diameter portion 28*b*, said shaft portions being divided by an integral annular flange 72. As shown in FIG. 2, the end of sleeve 50 engages one side of the flange 72** when the engine and governor mechanism is at rest.

A spider adaptor 74 is disposed on the governor shaft portion **28*a*, having an internal bore of the same shape as the flatted shaft so as to rotate therewith. A cylindrical portion 76 of the adaptor engages the inner race of bearing 30 and accordingly supports the shaft in rotation. A radial shoulder 78 of the adaptor engages one side of the bearing inner race which is clamped between the shoulder and the inner end of the gear element 80 of which the gear 36 is an integral part. A locknut 82 on the threaded end of the governor shaft secures the gear element 80** in position.

The spider 40 includes a central bore 86 which is rotatably disposed on a cylindrical portion 88 of the spider adaptor 74. The spider as indicated above, carries the opposed flyweights 42 which are pivotally mounted thereto by pivot pins 90.

A spider retainer 92 having a central bore 94 of the same flatted configuration as the portion **28*a* of the governor shaft is disposed on the shaft portion 28*a* between the flange 72 and the spider adaptor 74. The tightening of the nut 82 will accordingly secure the spider retainer 92, spider adaptor 74, inner race of the bearing 30 and the gear member 80 in contiguous relation against the flange 72** for rotation with the governor shaft.

Resilient means are provided for effecting a rotation of the spider 40 and the pivotally attached flyweights 42 with the governor shaft but permitting a resilient angular displacement thereof. This resilient means comprises a pair of spring assemblies 96 which are disposed in substantially diametrically opposed slots 98 of the spider 40. Each of the spring assemblies 96 comprises a compression spring 100 disposed around a cylindrical spring guide 102 having a first spring seat 104 at the outer end thereof, the spring seat having an arcuate outer face for cooperation with a similar curved end of the spider slot 98. The spring guide 102 slidably telescope within a bore 106 of a second spring seat 108 which is provided with pins 110 and 112 extending from opposite sides thereof. One of the pins 110 is rotatably seated within a bore 114 of a circular flange 116 of the spider adaptor 74 while the other pin 112 is rotatably seated within a bore 118 of the spider retainer 92. Each of the spring seats 108 accordingly rotates with the spider adaptor and spider retainer which are fixed to the governor shaft portion 28*a*, while the spring seats 104 are biased by the springs 100 into engagement with the ends of the slots 98 of the spider which thus becomes resiliently rotatable with respect to the spider adaptor surface 88 on which it is seated and hence the governor shaft.

Figure 5:
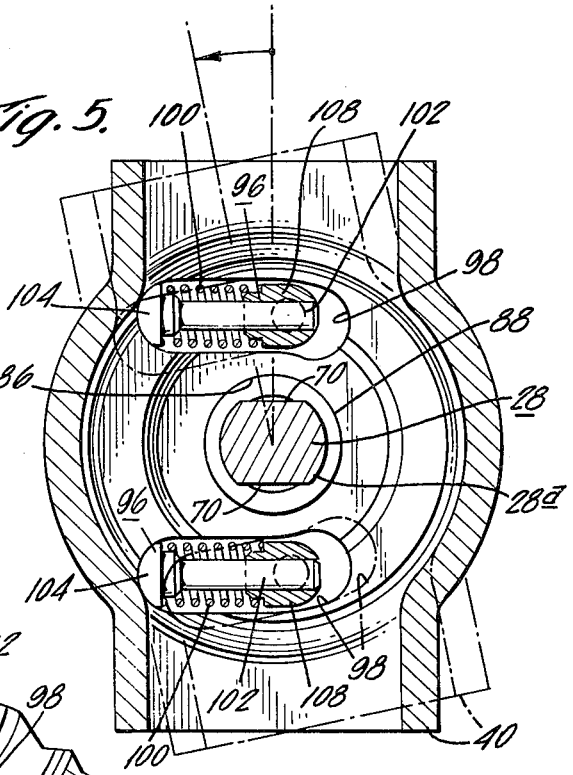
FIG. 5 is a sectional view taken along line 5—5 of FIG. 2 and showing in broken lines the angular displacement of the flyweight spider in response to an acceleration force.
Figure 5A:
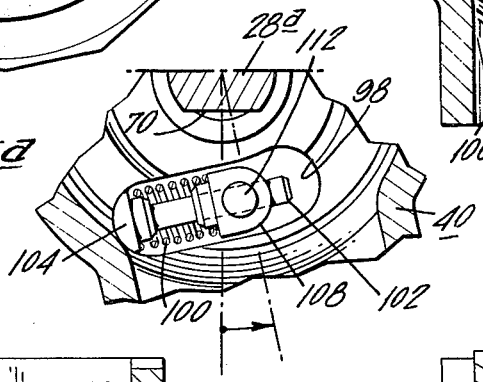
FIG. 5*a* is a partial view as in FIG. 5 showing the compression of one of the spring assemblies during the displacement of the spider.
Figure 6:
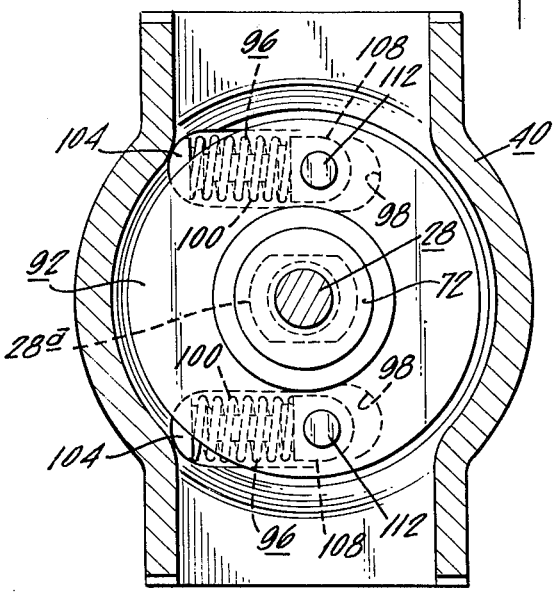
FIG. 6 is a sectional view taken along line 6—6 of FIG. 2.
Figure 7:
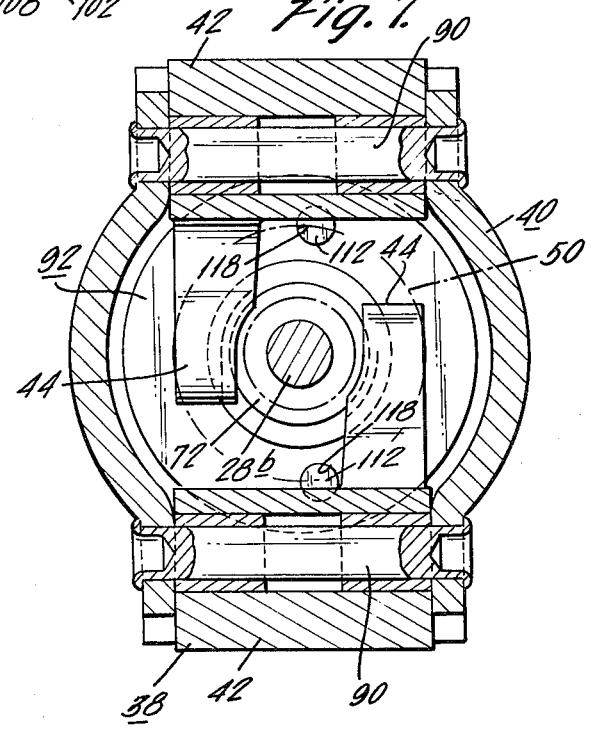
FIG. 7 is a sectional view taken along line 7—7 of FIG. 2.
Figure 8:
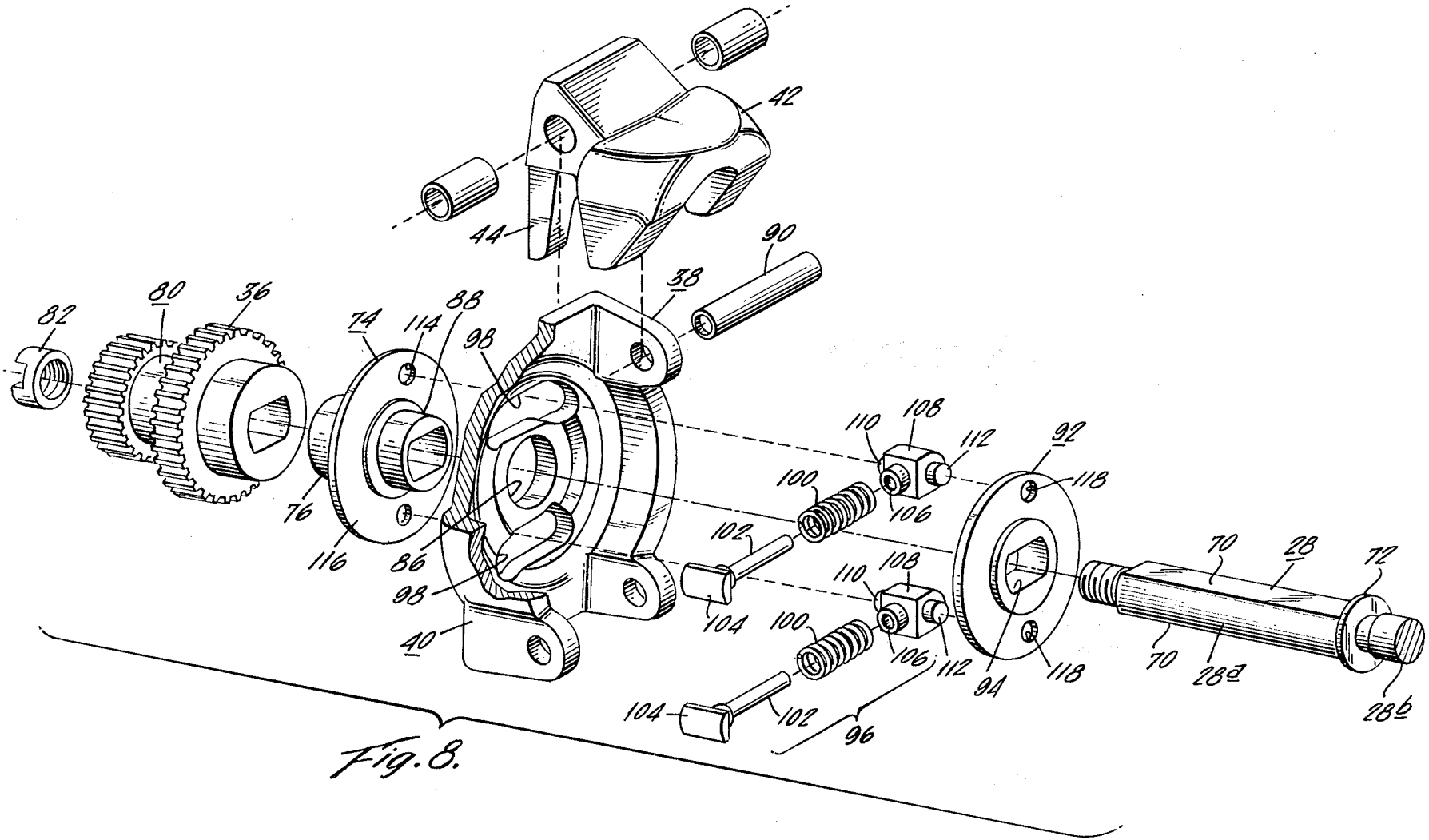
FIG. 8 is an exploded isometric view of the resilient drive shown in FIGS. 1–7.

As shown in FIG. 6, the springs are both in a compressed state when the engine is stopped and serve to position the spider in what might be called its normal rotational alignment with the spider adaptor and governor shaft. This is also the normal operating position of the spider with respect to the governor shaft at such times when the mechanism is not subjected to a torsional vibration from the pump drive train. Upon the occurrence of a momentary acceleration or deceleration force, the resilient drive permits the spider to rotate with respect to the spider adaptor and governor shaft to a limited degree as shown in FIG. 5 in broken lines, thereby further compressing one of the compression springs as the initial shock of the acceleration or deceleration is absorbed. The condition of the compressed spring under such a circumstance as shown in FIG. 5A. The compressed spring will quickly return the angularly displaced spider and the flyweights carried thereby back to the normal position of FIG. 6, but the impact of the torsional has been absorbed by the springs and will have a minimal and in most cases a negligible effect on the flyweights. The spider always rotates at the same rate as the governor shaft since the angular displacement with respect thereto is only momentary and can be no more than approximately 15° in either angular direction from its normal alignment. There can accordingly be no slippage of the spider with respect to the governor shaft as was possible in friction clutch type arrangements, and the speed of rotation of the spider will always be an accurate and reliable function of engine speed.

Although the preferred embodiment of the invention has been described above, it will be apparent that other closely related types of resilient drive arrangements for the spider could be utilized. For example, extension springs, torsion springs or any resilient drive member could be substituted for the compression spring assemblies to effect this function.

Similarly, it will be apparent that the particular type of governor illustrated is not essential for utilization of the invention. Other types of mechanical governors having a flyweight type speed sensing mechanism or the so-called mechanical-hydraulic governors wherein the speed is sensed mechanically but the control is effected hydraulically could also benefit from use of the present resilient drive.

Manifestly, changes in details of construction can be effected by those skilled in the art without departing from the spirit and scope of the invention.

We claim:

1. In a fuel injection pump governor for diesel engines comprising a governor shaft, means for rotating said governor shaft at a speed corresponding to engine speed, a flyweight assembly on said governor shaft for sensing the speed of rotation thereof, said flyweight assembly comprising a spider and at least one flyweight pivotally connected to said spider for rotation with respect to said spider in response to speed changes of the shaft, means operatively connected with said flyweight assembly for controlling fuel delivery under predetermined speed conditions as sensed by said flyweight assembly, the improvement comprising means resiliently connecting said flyweight assembly spider with said governor shaft to provide a rotation of said spider assembly at the same rate as said governor shaft while permitting a limited resilient relative rotation of said flyweight assembly with respect to said governor shaft, said latter means comprising a spider adpator disposed adjacent said spider and attached to said shaft on one side of said spider, a spider retainer attached to said shaft adjacent said spider on the opposite side thereof from said spider adaptor, a pair of substantially diametrically opposed slots in said spider, a spring assembly in each said slot, each said spring assembly comprising a first spring seat disposed in said slot and attached at opposite sides thereof to said spider adaptor and said spider retainer, a compression coil spring seated at one end on said first spring seat, a second spring set disposed at one end of said spider slot, said spring being seated at its other end on said second spring seat, and a spring guide extending from said second spring seat and passing through said coil spring into a bore in said first spring seat for sliding movement therewithin upon extension or contraction of said spring, said spring seats and spring guide serving to maintain spring alignment and minimize spring distortion, the springs of said spring assemblies being oppositely disposed so as to resiliently bias said spider toward a normal operating position with espect to said governor shaft intermediate the limit positions of its permissible rotation with respect thereto.

* * * * *